US011156442B1

(12) United States Patent
Kampo et al.

(10) Patent No.: US 11,156,442 B1
(45) Date of Patent: Oct. 26, 2021

(54) DYNAMIC INSTABILITY REDUCED RANGE ROUND

(71) Applicant: U.S. Government as Represented by the Secretary of the Army, Dover, NJ (US)

(72) Inventors: Kyle Kampo, Barnegat, NJ (US); Raymond Chaplin, Hopatcong, NJ (US); Sung Chung, Dover, NJ (US); Marco Duca, Dover, NJ (US); Gregory Rodebaugh, Doylestown, PA (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 71 days.

(21) Appl. No.: 16/595,857

(22) Filed: Oct. 8, 2019

Related U.S. Application Data

(60) Provisional application No. 62/744,305, filed on Oct. 11, 2018.

(51) Int. Cl.

| | |
|---|---|
| ***F42B 10/00*** | (2006.01) |
| ***F42B 10/54*** | (2006.01) |
| ***F42B 8/12*** | (2006.01) |
| *F42B 10/22* | (2006.01) |

(52) U.S. Cl.
CPC ..... *F42B 10/54* (2013.01); *F42B 8/12* (2013.01); *F42B 10/22* (2013.01)

(58) Field of Classification Search
CPC ..... F42B 12/40; F42B 12/50; F42B 10/54; F42B 8/12; F42B 10/22; H02M 7/48; C03B 2201/08; C03B 2201/28
USPC ..... 102/529, 502, 367, 370, 444, 464
See application file for complete search history.

(56) References Cited

U.S. PATENT DOCUMENTS

| | | | | |
|---|---|---|---|---|
| 1,531,624 | A | 3/1925 | Richardson | |
| 3,528,662 | A * | 9/1970 | Engle | F42B 12/362 473/577 |
| 3,580,179 | A | 5/1971 | Gawlick | |
| 3,800,706 | A | 4/1974 | Gawlick | |
| 4,128,060 | A * | 12/1978 | Gawlick | F42B 10/34 102/529 |
| 4,133,265 | A | 1/1979 | Diesinger | |
| 4,140,061 | A * | 2/1979 | Campoli | F42B 14/061 102/521 |
| 4,206,968 | A * | 6/1980 | Suganuma | C03B 37/018 385/127 |
| 4,241,660 | A * | 12/1980 | Donovan | F42B 10/48 102/376 |
| 4,807,532 | A | 2/1989 | Andersson | |
| 4,827,847 | A | 5/1989 | Laviolette | |

(Continued)

FOREIGN PATENT DOCUMENTS

| | | |
|---|---|---|
| DE | 4018385 | 12/1991 |
| EP | 0071322 | 5/1986 |

*Primary Examiner* — Michael D David
(74) *Attorney, Agent, or Firm* — John P. DiScala

(57) ABSTRACT

A multi-piece projectile for a small arm training ammunition round maintains stable flight until reaching transonic speeds. During transonic and subsonic flight, aerodynamic features located on the projectile generate a pressure differential to increase limit cycle motion of the projectile. The aerodynamic features are located on a portion of the projectile which does not interface with rifling elements of the gun barrel and may include protrusions in or extrusions from the projectile.

9 Claims, 8 Drawing Sheets

(56) References Cited

U.S. PATENT DOCUMENTS

| | | | | | |
|---|---|---|---|---|---|
| 4,911,080 | A * | 3/1990 | Leeker | F42B 10/50 | 102/489 |
| H768 | H * | 4/1990 | Kline | 102/529 | |
| H770 | H * | 4/1990 | Kline | 102/513 | |
| 5,001,986 | A * | 3/1991 | Meister | F42B 10/48 | 102/529 |
| 5,125,344 | A | 6/1992 | Kline | | |
| 5,402,729 | A * | 4/1995 | Richert | F41A 11/04 | 102/334 |
| 5,476,045 | A | 12/1995 | Chung | | |
| 5,671,559 | A * | 9/1997 | Ludaesher | F41B 9/00 | 222/79 |
| 5,932,836 | A | 8/1999 | White | | |
| 5,965,839 | A * | 10/1999 | Vasel | H02M 7/48 | 102/367 |
| 6,393,992 | B1 * | 5/2002 | Vasel | F41B 15/02 | 102/367 |
| 6,543,365 | B1 * | 4/2003 | Vasel | F41B 11/57 | 102/502 |
| RE38,261 | E | 10/2003 | White | | |
| 8,640,624 | B1 * | 2/2014 | Hassan | F42B 8/14 | 102/506 |
| 9,121,679 | B1 | 9/2015 | Kim | | |
| 9,157,713 | B1 | 10/2015 | Peterson | | |
| 9,200,877 | B1 * | 12/2015 | Rubin | F42B 12/36 | |
| 9,500,454 | B1 * | 11/2016 | Decker | F42B 30/10 | |
| 9,841,401 | B2 | 12/2017 | Huang | | |
| 10,139,208 | B2 | 11/2018 | Andersson | | |
| 10,443,993 | B1 * | 10/2019 | Chaplin | F42B 14/065 | |
| 2002/0152914 | A1 | 10/2002 | Cox | | |
| 2005/0016412 | A1 * | 1/2005 | Vasel | F42B 7/10 | 102/502 |
| 2011/0226149 | A1 | 9/2011 | Tepe | | |

* cited by examiner

DYNAMIC INSTABILITY REDUCED RANGE ROUND

CROSS-REFERENCE TO RELATED APPLICATIONS

This application claims the benefit under 35 USC § 119(e) of U.S. provisional patent application 62/744,305 filed on Oct. 11, 2018.

STATEMENT OF GOVERNMENT INTEREST

The inventions described herein may be manufactured, used and licensed by or for the United States Government.

BACKGROUND OF THE INVENTION

The invention relates in general to small arms and in particular to ammunition for small arms.

Effective training with small arms is imperative to the overall mission of the Armed Forces. Standard issue combat ammunition is designed to have the longest effective range possible. While this is advantageous in combat situations it results in large surface danger zones for training at practice ranges and during collective training. For training purposes, it is often better for the military to use a training round with reduced maximum range when compared with the standard combat ball ammo. Ideally, a training round should also have a trajectory match out to a desired training range in order to make the users transition between the training ammo and the combat ammo seamless.

Small caliber projectiles, which generally comprise projectiles .50 caliber and smaller, designed for training have existed for over a century. Some original designs were used for short range training and consisted of projectiles being made entirely out of wax. Since then, training ammunition has come in all different forms and with different mechanisms. One of the more common mechanisms is a pyrotechnic mechanism. These design vary in how they employ pyrotechnics to reduce the flight range of the projectile. For example, exploding projectiles use a reactive material that burns to introduce a de-stability in a projectile. Another such method is by using the effects of a liquid core to destabilize the projectile during flight.

Other projectile designs exist which reduce the range of the projectiles using geometric features. For example, U.S. Pat. No. 3,800,706 describes a projectile having a spin breaking mechanism arranged in the ogive section of a projectile, with a central bored out section at the tip of the projectile. The bored out section extends towards the base of the projectile, with the end of the bore section extending, perpendicular to the original bore path, to break the surface of the sides of the projectile. This design allows for the two features of the projectiles to act as a spin break and destabilize the projectile. This design uses a spin break mechanism to destabilize the projectile and accordingly, it requires both the geometric changes to the front of the projectile, as well as a bore cut into the projectile.

Other approaches use geometric features to reduce the gyroscopic stability of the projectile. For example, the projectile described in U.S. Pat. No. 5,932,836 uses an augmented roll dampening effect, which results in the projectile going gyroscopically unstable at a specific distance. Due to the aeroballistic mechanism used to restrict the range of this round, the location of where the geometric features are located in this approach leave it susceptible to complications caused by the engraving process. The US Government also possesses U.S. Pat. No. 5,476,045 and US Statutory Invention Registration H768, which are designs for small caliber training ammunition. U.S. Pat. No. 5,476,045 is a projectile designed to be stabilized, when fired out of a smooth bore weapon, with the addition of fins attached to the base of the projectile. These fins are used to generate the spin needed to stabilize the projectile in flight to a maximum distance of 500 m. By that distance, the projectile destabilizes and falls out of the sky. US Statutory Invention Registration H768 also uses fins attached to the base of the projectile to reduce the flight of the projectile. These fins are used to generate a spin dampening torque which is used to cause a gyroscopic instability during flight.

A need exists for an improved round which uses a different aeroballistic mechanism than previously disclosed to overcome the limitations of previous approaches, namely the location of geometric features on the round.

SUMMARY OF INVENTION

One aspect of the invention is a projectile for a small arms training ammunition round. The projectile comprises an aerodynamic feature located on a portion of the projectile which does not interface with a rifling of the gun barrel and which generates a pressure differential during transonic and subsonic flight to increase limit cycle motion of the projectile.

Another aspect of the invention is a multi-piece projectile for a small arms training ammunition round. The multi-piece projectile comprises a main body and a penetrator which extends from the distal end of the main body. The penetrator comprises a portion of the ogive portion. The multi-piece projectile includes an aerodynamic feature located on a portion of the projectile which does not interface with a rifling of a gun barrel and which generates a pressure differential during transonic and subsonic flight to increase limit cycle motion of the projectile.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

Prior Art

DETAILED DESCRIPTION

Figure 1:
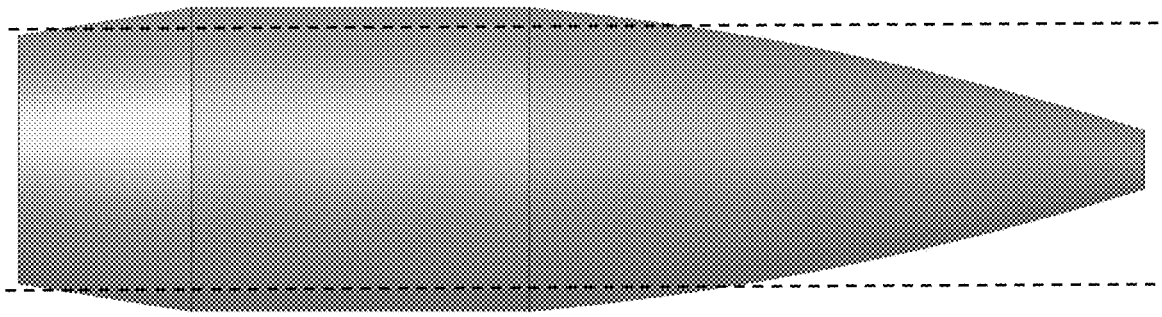
Prior Art FIG. 1
FIG. 1 is a side view of standard ammunition round projectile.

A projectile for an ammunition training round includes one or more aerodynamic features which allows the projectile to perform similar to conventional ammunition within a portion of its trajectory but limits the overall range of the projectile. The projectile has similar aeroballistic performance to conventional ammunition during supersonic flight, or flight at speeds greater than approximately 1.2 Mach. During transonic (approximately 1.2 Mach to 0.8 Mach) flight the projectile begins to destabilize due to increasing limit cycle motion, and once the projectile enters subsonic flight (less than approximately 0.8 Mach), the projectile is dynamically unstable, resulting in a reduction of maximum flight distance.

The projectile includes aerodynamic features on either a portion of the ogive or extending from the base of the projectile. The portion of the ogive may either be on the surface of an ogive integral to a unitary projectile or may be on the surface of a penetrator which forms a multi-piece projectile. Critically, these aerodynamic features must be located such that the feature's geometry or effects are not altered, or interfered with in any way, by the engraving process of the projectile being fired out of a rifle.

Most spin stabilized projectiles have a limit cycle (coning) motion. The coning motion, which is more prevalent during transonic and subsonic flight, is primarily formed due to the balance between the Magnus moment and pitch damping moment of the projectile when the projectile is experiencing an angle of attack between two and four degrees.

The aerodynamic features of the projectile described herein generate a pressure differential which results in an increased limit cycle motion and at transonic and subsonic speeds, dynamic instability. During supersonic flight, the supersonic flow of the air over the projectile generates a supersonic shockwave off the nose of the projectile. The shockwave, combined with the high rotation rate of the projectile, and tendency for turbulent airflow to be suppressed during supersonic flight, causes the pressure differential generated by the aerodynamic features to have little to no effect on the aeroballistic performance of the projectile during supersonic flight. Accordingly, the projectile has a similar aeroballistic performance to conventional ammunition during supersonic flight.

During transonic and subsonic flight, the pressure differential generated by the aerodynamic features increases, resulting in an increase in the limit cycle motion of the projectile. This increase in limit cycle motion, and enhancement of the Magnus moment effect, is not only prevalent during the standard angle of attack range of 2° to 4°, where this motion is normally present, but is also present at an angle of attack larger than the standard magnitude. This increased limit cycle motion results in the projectile going dynamically unstable. The dynamic instability greatly increases the drag of the projectile due to large angles of attack, thus greatly reducing the overall range of the projectile. Advantageously, while the overall range of the projectile is reduced, the projectile travels in a predictable forward path and does not behave erratically or unpredictably while unstable as is witnessed in other approaches.

Prior Art FIG. 1 is a side view of standard ammunition round projectile. Prior Art FIG. 1 shows a conventional projectile comprising an ogive, a cylindrical midsection, a boattail and a base. Dotted lines show the region of the projectile where the rifling can interfere with aerodynamic features present on the projectile. Aerodynamic features above and below each dotted line, will likely be interfered with by the rifling prior to exiting the barrel and accordingly, may not function as desired.

Figure 2:
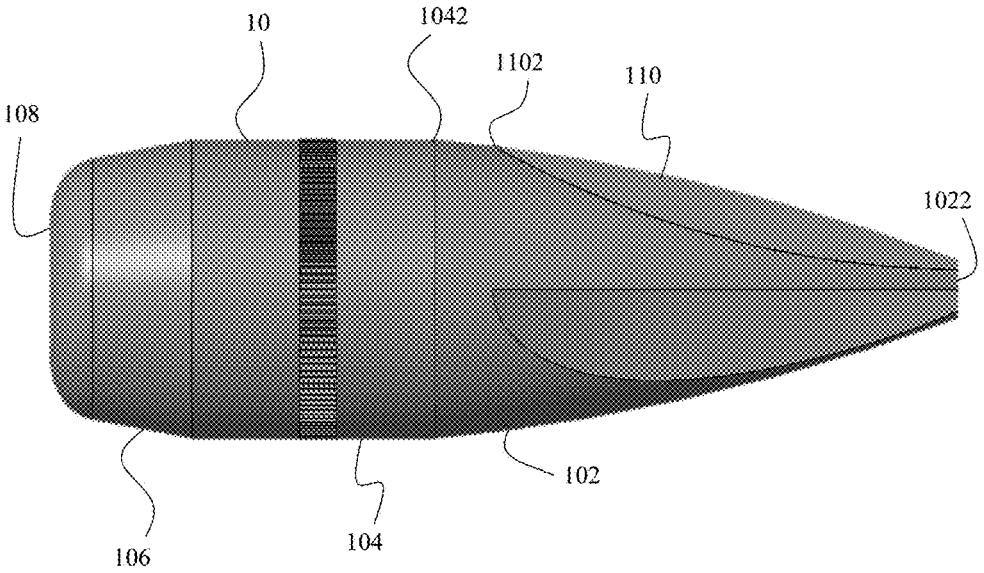
FIG. 2 is side view of a training ammunition round projectile with aerodynamic features in the ogive, according to one illustrative embodiment.
Figure 3:
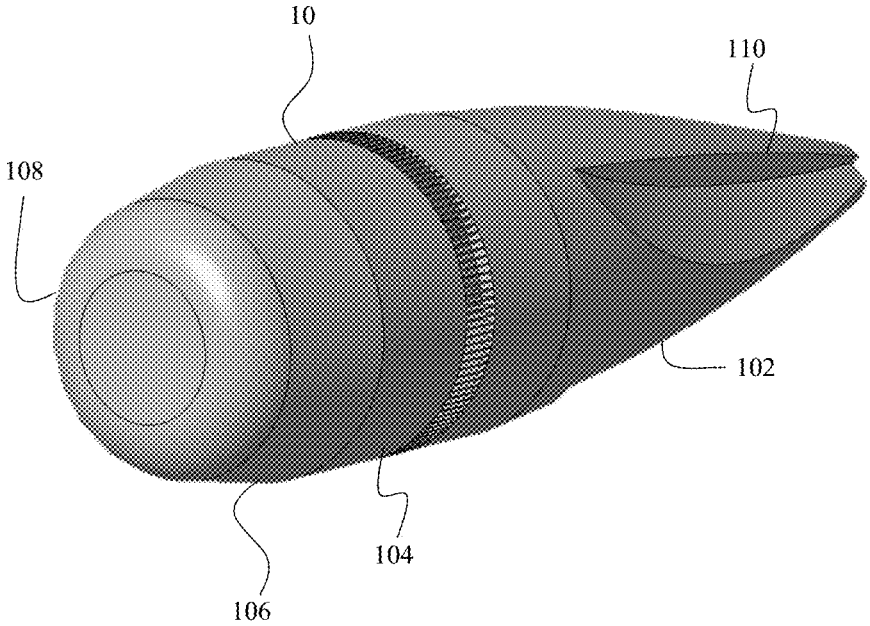
FIG. 3 is a side rear perspective view of the training ammunition round projectile with aerodynamic features in the ogive, according to one illustrative embodiment.

FIG. 2 is side view of a training ammunition round projectile with aerodynamic features in the ogive, according to one illustrative embodiment. FIG. 3 is a side rear perspective view of the training ammunition round projectile of FIG. 2, according to one illustrative embodiment. The training ammunition round projectile 10 is a spin stabilized projectile designed to be fired though a rifled weapon barrel or tube for training purposes. For example, the training ammunition round projectile 10 may be sized and dimensioned of a caliber suitable to be fired from a machine gun, rifle or pistol. Example embodiments include, but are not limited to 5.56 mm, 6.8 mm or 7.62 mm rounds. Aerodynamic features in the form of extrusions in the ogive generate the pressure differential, resulting in an increase in the limit cycle motion of the projectile 10.

The training ammunition round projectile 10 comprises an ogive 102, a cylindrical midsection 104, a boattail 106 and a base 108. The ogive 102 has a forward end at the meplat 1022 of the round and extends rearward to the cylindrical midsection 104. The cylindrical midsection 104 is forward of the boattail 106. The boattail 106 terminates at the base 108 of the projectile 10.

The ogive 102 further comprises a series of radial cuts 110 in the outer surface of the ogive 102. The radial cuts 110 are arranged symmetrically around the outer surface of the ogive 102. The longitudinal axis of each cut 110 is generally in alignment with the longitudinal axis of the projectile 10.

The training ammunition projectile 10 shown in FIGS. 2 and 3 comprises four radial cuts 110 arranged symmetrically around the circumference of the projectile 10. To state another way, each of the cuts 110 is ninety degrees away from its neighboring cuts 110. However, the projectile 10 is not limited to having four cuts 110 and may comprise more than four cuts 110 or less than four cuts 110. As will be described in more detail below, the cuts 110 must have a sufficient total volume to induce dynamic instability at transonic and subsonic speeds. Increasing the total number of cuts 110 may allow for a projectile 10 with less voluminous cuts 110.

Critically, the cuts 110 do not extend into a region of the ogive 102 which interfaces with the rifling of the firearm. In one embodiment, a predetermined start distance 1102 from the proximate end of the cuts to the forward end 1042 of cylindrical midsection 104 is the controlling variable for the overall dimensions of the cuts 110. The location of the predetermined start distance 1102 is controlled by the specific caliber of the projectile 10. Conventional small caliber ammunition have a corresponding, defined barrel rifling diameter, which will engrave the projectile 10 at known diameter. The location where this engraving happens is determined to be the furthest point on the ogive cuts 110 can end, in reference to the projectile's meplat 1022. By setting the predetermined start distance 1102 first and then choosing the other geometric variables based on this predetermined distance 1102, the cuts 110 are ensured to not be rendered ineffective by the rifling.

Figure 4A:
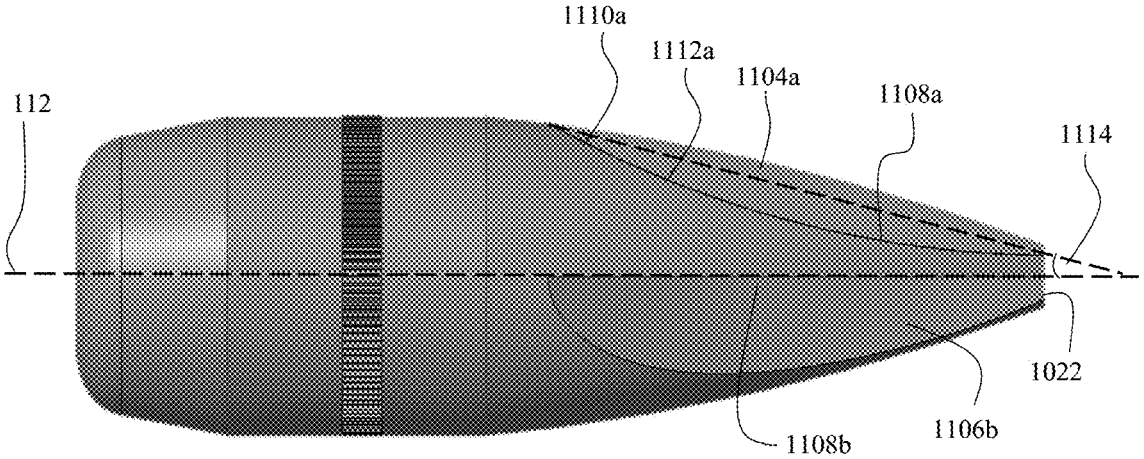
FIG. 4A is side view of a training ammunition round projectile with aerodynamic features in the ogive, according to one illustrative embodiment.
Figure 4B:
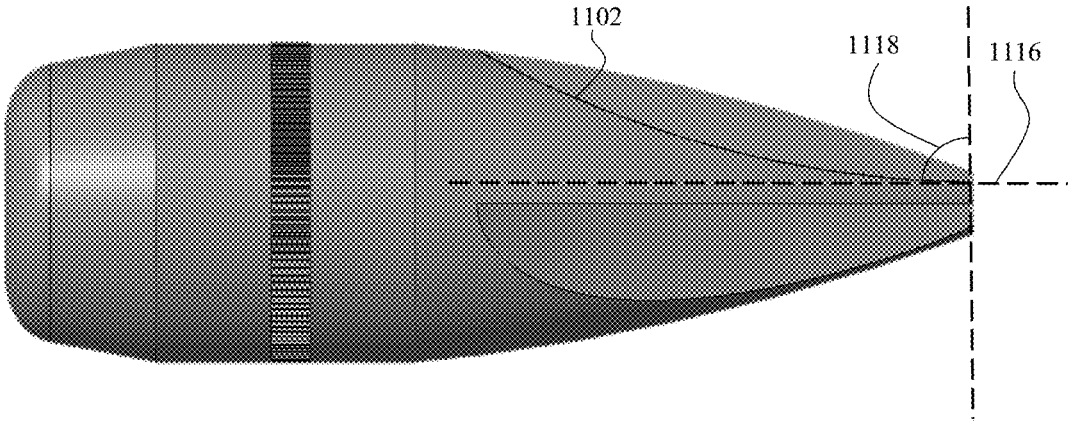
FIG. 4B is side view of a training ammunition round projectile with aerodynamic features in the ogive, according to one illustrative embodiment.

FIG. 4A and FIG. 4B are side views of a training ammunition round projectile with aerodynamic features in the ogive, according to one illustrative embodiment. Each cut 110 is defined by a first surface 1104 (individually and collectively 1104) and a second surface 1106 (individually b and collectively 1106). The first surface 1104 is a generally flat surface and may be formed by a lateral incision toward the longitudinal axis 112 of the ogive 102. The second surface 1106 is generally radial in shape and curves from near the center of the projectile 10 to the outer surface of the ogive 102. The first surface 1104 and the second surface 1106 intersect at a base edge 1108 (a, b and collectively 1108) to define the cut 110.

The first surface 1104 is positioned such that during rotation of the projectile 10 in flight, the first surface 1104 serves as the leading surface. The first surface 1104 rotates toward and interacts with the surrounding air which causes turbulent vortices to form. Accordingly, the first surface 1104 must be sized and dimensioned to have sufficient surface area to induce dynamic instability at transonic and subsonic speeds. The surface area is tunable according to cut constraints as described below.

The second surface 1106 further comprises an outer edge 1110 (individually and collectively 1110) which includes an arc 1112 (individually and collectively 1112). In the embodiment shown in FIGS. 2-5, the arc 1112 encompasses the entire outer edge 1110. To state another way, the arc 1112 begins at the meplat 1022 of the projectile 10. However, in other embodiments, the arc 1112 may only be a portion of the outer edge 1110. For example, as will be described further in reference to FIG. 8, the outer edge 1110 may proceed away from the meplat 1022 of the projectile 10 in a generally straight line thereby forming a plane that is orthogonal to the first surface 1104. The outer edge 1110 may then arc upward at some point rear of the meplat 1022 and away from the center of the projectile 10.

Critically, the angle 1114 of the chord length of the arc 1112 with respect to the longitudinal axis 112 of the projectile 10 must be within a certain range for the cuts 110 to be effective at inducing dynamic instability. If the angle 1114 is too large, thereby resulting in a cut that is too deep, dynamic instability is induced during supersonic flight thereby negating the benefit of the projectile 10. If the angle 1114 is too small, thereby resulting in a cut that is too shallow, dynamic instability will not be induced at transonic and subsonic speeds. In one embodiment, the angle 1114 of the arc chord is between approximately eight degrees and twelve degrees.

In addition, the forward end of the arc 1112 must not have a tangent line 1116 which intersects the meplat at an angle 1118 greater than ninety degrees. That is to say that as the arc 1112 nears the meplat, the slope of the arc must not change direction.

The surface area of the two surfaces are tunable to caliber specific needs. The surface area of each is controlled by the constraints for the lateral and curved incisions which create the surfaces. These constraints include the predetermined start distance 1102, the angle 1112 of the arc chord length and the limitation on the angle 1118 of the tangent line not exceeding an angle perpendicular to the meplat.

Figure 5:
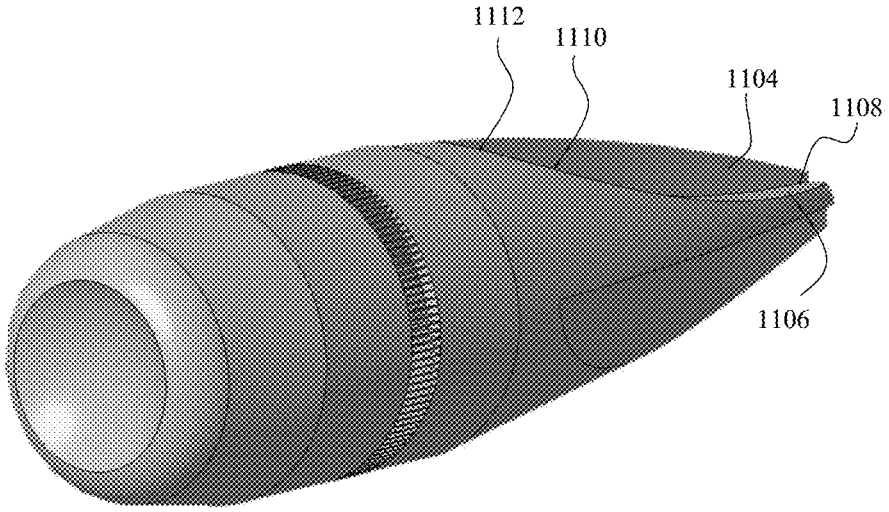
FIG. 5 is a side rear perspective view of the training ammunition round projectile with aerodynamic features in the ogive and base, according to one illustrative embodiment.

FIG. 5 is a side rear perspective view of the training ammunition round projectile with aerodynamic features in the ogive and base, according to one illustrative embodiment. The training ammunition round projectile 10 of FIG. 2 and FIG. 3 may further be modified to include a semi-circular extrusion in the base of the projectile 10. The extrusion is defined by the concave outer surface of the base.

Figure 6:
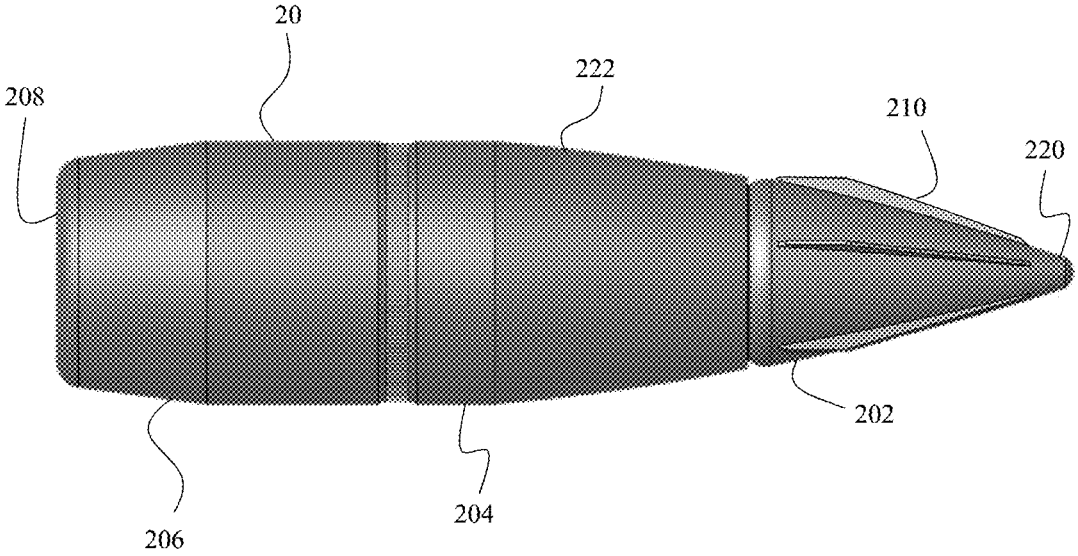
FIG. 6 is side view of a multi-piece training ammunition round projectile with aerodynamic features in the ogive, according to one illustrative embodiment.

FIG. 6 is side view of a multi-piece training ammunition round projectile with aerodynamic features in the ogive, according to one illustrative embodiment. In another embodiment of the projectile, the projectile 20 is a multi-piece projectile comprising a main body 222 and a penetrator 220. The penetrator 220 is at the tip end of the projectile 20 and is fixed to the main body 222. The penetrator 220 comprises a portion of the ogive 202 of the projectile with the remaining portion formed by the main body 222. The main body 222 further comprises a cylindrical midsection 204, a boattail 206 and a base 208.

In this embodiment, the aerodynamic features which generate the pressure differential are located on the penetrator 220 so as not to interfere with the rifling of the firearm. Additionally, the fins 210 are located so as not to interfere with the chambering of the round, the process by which the weapon action or bolt closes with a cartridge sitting in the chamber ready to fire upon trigger pull, or feeding of the round, the process of a round being pulled from a magazine or belt and fed into the chamber of the weapon.

In the embodiment shown in FIG. 6, the aerodynamic features comprise radial fins 210 extending outward from the outer surface of the penetrator 220 tip. The fins 210 are arranged symmetrically around the penetrator 220 and are substantially aligned with the longitudinal axis of the penetrator 220.

The side profile of each fin 210 is generally triangular in shape such that the height of the fin 210 increases in the direction away from the tip until a vertex point at which the height then decreases in the direction away from the tip. As the fins 210 rotate into the airstream, the leading surface of each fin 210 generates the pressure differential, resulting in an increase in the limit cycle motion of the projectile 20.

Figure 7:
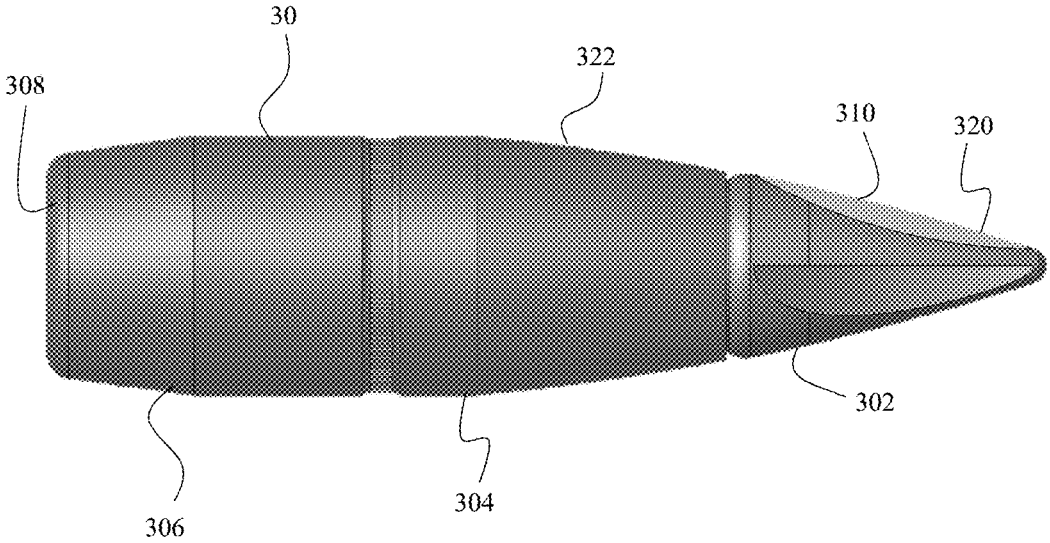
FIG. 7 is side view of a multi-piece training ammunition round projectile with aerodynamic features in the ogive, according to one illustrative embodiment.

FIG. 7 is side view of a multi-piece training ammunition round projectile with aerodynamic features in the ogive, according to one illustrative embodiment.

In another embodiment of the projectile, the projectile 30 is a multi-piece projectile comprising a main body 322 and a penetrator 320. The penetrator 320 is at the tip end of the projectile 30 and is fixed to the main body 322. The penetrator 320 comprises a portion of the ogive 302 of the projectile with the remaining portion formed by the main body 322. The main body 322 further comprises a cylindrical midsection 304, a boattail 306 and a base 308.

In the embodiment shown in FIG. 7, the aerodynamic features comprise radial cuts 310 in the penetrator 220 similar in nature to the radial cuts 220 described in relation to FIGS. 2-5.

Figure 8:
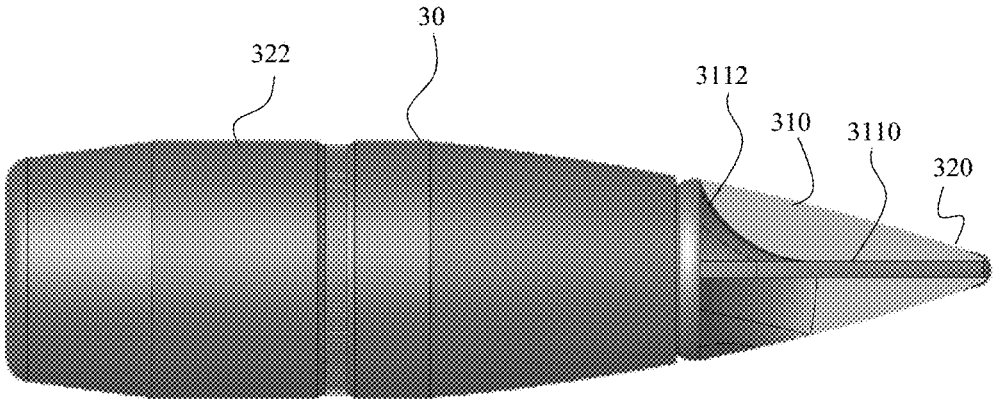
FIG. 8 is side view of a multi-piece training ammunition round projectile with aerodynamic features in the ogive, according to one illustrative embodiment.

FIG. 8 is side view of a multi-piece training ammunition round projectile with aerodynamic features in the ogive, according to one illustrative embodiment. The aerodynamic features comprise radial cuts 310 in the penetrator 220. In the embodiment shown in FIG. 8, the outer edge 3110 of the second surface comprises a straight portion at the distal end of the outer edge near the tip and an arc 3112 rearward of the straight portion.

The embodiment shown in FIG. 8 shows an exaggerated angle of elevation of the chord length of the arc 3112 to illustrate that the outer edge may comprise both a straight and curved section. As in embodiments in which the entire outer edge 3110 is an arc, the angle of elevation of the chord of the arc 3112 must be within a range of 8-12 degrees to induce the desired effect.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile for a small arms training ammunition round which comprises an aerodynamic feature located on an ogive of the projectile which does not interface with the rifling of a gun barrel and which generates a pressure differential which during transonic and subsonic flight increases the limit cycle motion of the projectile thereby causing the projectile to become dynamically unstable, wherein the aerodynamic feature comprises one or more radial cuts, said one or more radial cuts being defined by a first surface and a second surface, wherein the first surface comprises a flat surface extending radially outward from a central longitudinal axis of the projectile and the second surface comprises a curved surface intersecting with the first surface at a base edge.

2. The projectile of claim 1 wherein the one or more radial cuts are a predetermined cut distance from a cylindrical midsection determined by a barrel rifling diameter.

3. The projectile of claim 1 wherein the curved surface further comprises an outer edge comprising an arc and wherein an angle of a chord of the arc is within a range of eight degrees to twelve degrees.

4. The projectile of claim 1 wherein the arc is dimensioned such that an angle formed by a tangent line to the arc is less than or equal to ninety degrees with respect to a meplat of the projectile.

5. The projectile of claim 1 further comprising a semicircular depression in a base of the projectile.

6. A multi-piece projectile for a small arm training ammunition round which comprises:

a main body;

a penetrator extending from the distal end of the main body, wherein the penetrator comprises a portion of an ogive; and an aerodynamic feature located on the portion of the ogive located on the penetrator, wherein said portion of the ogive does not interface with a rifling of a gun barrel, wherein the aerodynamic feature generates a pressure differential which during transonic and subsonic flight increases the limit cycle motion of the projectile thereby causing the projectile to become dynamically unstable and wherein the aerodynamic feature comprises one or more radial cuts, said one or more radial cuts being defined by a first surface and a second surface, wherein the first surface comprises a flat surface extending radially outward from a central longitudinal axis of the projectile and the second surface comprises a curved surface intersecting with the first surface at a base edge.

7. The projectile of claim 6 wherein the one or more radial cuts are a predetermined cut distance from a cylindrical midsection determined by a barrel rifling diameter.

8. The projectile of claim 6 wherein the curved surface further comprises an outer edge comprising an arc and wherein an angle of a chord of the arc is within a range of nine degrees to ten degrees.

9. The projectile of claim 6 wherein the arc is dimensioned such that an angle formed by a tangent line to the arc is less than or equal to ninety degrees with respect to a meplat of the projectile.

* * * * *